United States Patent [19]

Van Doorn et al.

[11] Patent Number: 4,550,657

[45] Date of Patent: Nov. 5, 1985

[54] BALING CHAMBER ASSEMBLY

[75] Inventors: Donald W. Van Doorn; James B. Hawkins; Francis W. Carpenter, III; Robert E. Lange; Tommy W. Webb, 2021 Coventry Dr., all of Columbus, Ga.

[73] Assignee: Lummus Industries, Inc., Columbus, Ga.

[21] Appl. No.: 662,226

[22] Filed: Oct. 18, 1984

[51] Int. Cl.[4] ..... B30B 15/16

[52] U.S. Cl. ..... 100/43; 100/218; 100/246; 100/255; 100/269 R

[58] Field of Search ..... 100/43, 218, 255, 269 R, 100/246, 247, 252, 253, 254

[56] References Cited

U.S. PATENT DOCUMENTS 716,422 12/1902 Hulscher ..... 100/246 X 2,207,032 7/1940 Steinhauer ..... 100/255

3,584,433 6/1971 Van Doorn ..... 100/218 X 3,985,072 10/1976 Van Doorn ..... 100/255

4,136,609 1/1979 Van Doorn ..... 100/255 X

FOREIGN PATENT DOCUMENTS 1145926 3/1963 Fed. Rep. of Germany ..... 100/255

*Primary Examiner*—Billy J. Wilhite

*Attorney, Agent, or Firm*—Woodford R. Thompson, Jr.

[57] ABSTRACT

A baling chamber for a fiber press utilizing rigid upright doors pivotally mounted along their lower portions to contain fibers compressed thereinto by a moving platen. The doors separate slightly at the upper portion thereof responsive to the final compression of the bale thereby reducing the lateral pressure on the bale. One of the doors has rollers thereon to cooperatively engage a track parallel therewith such that the door may be displaced for removal of the bale.

10 Claims, 3 Drawing Figures

10
13
16
17
18
19
19'
20
21
23
24
25
26
27
28
29
31
32
33
36
37
39
41
42
46
48
49
53
59
60
61
62
63
64
65
66
70
109

BALING CHAMBER ASSEMBLY

BACKGROUND OF THE INVENTION

The present invention relates to the field of baling fibrous materials and more particularly to a baling chamber assembly for a baling press. In even greater particularity the invention may be described as an improved baling chamber utilizing horizontally pivoting baling doors which are positionally controlled by the operating parameters of the baling press.

The basic configuration of the single box up-packing baler having a hinged charging box operating below floor level is well known. In the past, single box up-packing balers had a serious drawback in that the wrapping material for the bottom of the bale had to be manually placed on the bottom platen of the press just before the last charge. This was done by an operator lowering himself into the charging box of the press and placing the lower half of the wrapping material on the moving platen underneath the fiber which was held in position by dogs. This operation was especially dangerous with automated baling equipment inasmuch as either upward movement of the ram or the closing of the charging door would be disastrous.

Previous baling chamber assemblies have utilized doors which were vertically hinged, as for example in U.S. Pat. No. 3,985,072. Some baling chambers of this type construction presented hazards to the machine operator inasmuch as the high compression forces had the ability to kick the door open as the operator attempted to open the door. This unexpected release of the compressive force, especially when the bale was warped in an S or C shaped bow in the chamber, has resulted in serious injury. It is thus desirable to release some of the lateral pressure on the forming bale during the final compression. Also, when vertically hinged doors have been utilized the doors typically open at one end of the bale, thus releasing the lateral pressure unevenly across the face of the bale.

It is also important to be able to charge as much fiber as possible into the charging box below floor level. In so doing fiber is left in the area between the means for delivering lint to the baler and the charge door, which must be closed to form the charging box on the baler. This presents a major problem in operating this type of press inasmuch as this mass of fiber must be severed, which presents a problem about as difficult as biting through steel.

SUMMARY OF THE INVENTION

It is an object of the present invention to provide a baling chamber which provides for an even release of lateral pressure along the face of a bale.

Another object of the invention is to provide a safer baling chamber which would not be subject to any unexpected and violent opening of the chamber door.

Yet another object of the present invention is to provide an up-packing baler wherein the baling chamber doors are fully automated to facilitate tying of the bale within the baling chamber and the automatic ejection of the bale subsequent to the tying operation.

These objects which serve to overcome some of the disadvantages of the prior art are advantageously accomplished in the instant invention by the use of a unique door assembly which forms the baling chamber of the up-packing baler. The baling chamber utilizes four rigid doors: two end doors and two side doors.

However, the doors are horizontally mounted along a line at their lower portions rather than being vertically hinged as is common in the prior art. The lower portion of each door has a weight bearing flange extending therefrom and cooperatively retained in place such that the doors may pivot outwardly under the influence of hydraulic cylinders connected across the baling chamber between the upper portions of the end doors and side doors, respectively. This outward motion is used to relieve lateral pressure exerted by the baler in packing the fibrous material. One of the side doors has mounted thereon rollers such that upon completion of the packing operation and the subsequent tying operation, the roller mounted side door may be pivoted through an additional arc such that the rollers engage a track parallel to the door. When so engaged the rollers may be utilized to move the side door away from the baling chamber so that the tied bale within the chamber may be ejected.

BRIEF DESCRIPTION OF DRAWINGS

The novel features to be patented are set forth in the appended claims; however a fuller understanding of the operation of the instant invention as well as appreciation of the other objects, features and advantages of the instant invention may be gained from a perusal of the description of the preferred embodiment in conjunction with the attached drawings.

DETAILED DESCRIPTION

Figure 1:
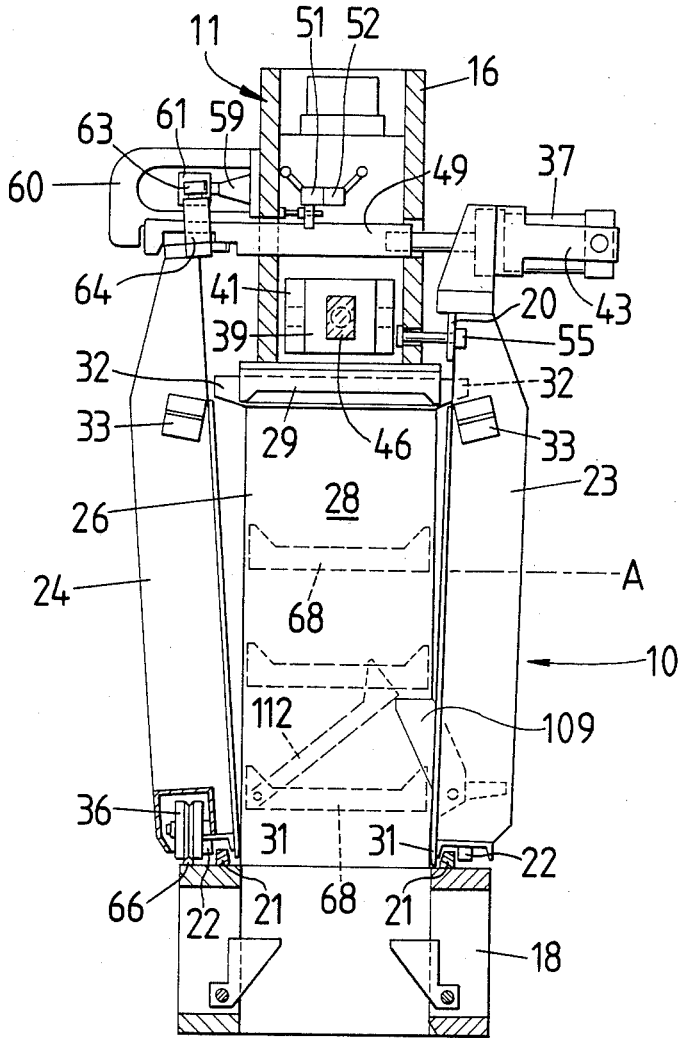
FIG. 1 is a vertical cross sectional view of the baling chamber.

Fibrous material, such as cotton lint, under compression, does not exhibit any significant lateral expansion. In fact, the amount of lateral expansion occuring varies inversely with the amount of compression on the fibers. Due to this phenomenon, it has been observed that fiber bales have an appreciable taper in that they are generally slightly wider at the top (volume experiencing least compression) than at the bottom (volume experiencing greatest compression). As will be explained hereinafter the unique design of the instant baling chamber utilizes this taper to release lateral pressure on the bale evenly across the face of the bale.

With reference to the drawings, an up-packing baler is shown generally at 10. This baler will be described with reference to two major sections: an upper press section shown generally at 11, and a lower press section shown generally at 12. The lower press section 12 is located beneath a floor plate 17 and is in fact beneath the floor of the working space as is conventional with up-packing balers. Strain rods 13 connect the two major sections from a bottom sill, not shown, to a top sill 16. It should also be understood that the entire structure is mounted relative to the floor in a rather conventional manner. Above the floor plate 17 is a sleeve support 18. The upper surface of the sleeve support 18 has projections 21 which are utilized in mounting the rigid baling chamber doors. Mounted thereabove are a rear side door 23 and a front side door 24 and two end doors 26 and 27, which in conjunction with top platen 29, form a baling chamber 28.

The front and rear side doors are of a novel construction. Each door comprises a plurality of vertical plates 19 evenly spaced across the door. Each vertical plate 19 is supported by a strength member 19' which also is vertically oriented and which is mounted to upper and lower horizontal beams 20. Between each pair of vertical plates 19 is a slot 25 which cooperates with the slotted top platen 29 and the slotted bottom platen 68 to facilitate tying the bale as will be explained hereinafter.

The lower portion of each of the doors 23–24 and 26–27 have extending downwardly therefrom a weight bearing flange 31. Each flange 31 rests on the upper surface of sleeve support 18 inwardly of the projections 21. Each flange 31 thus abuts the adjacent projection 21, thereby restraining outward movement of the lower portion of each door.

Figure 2:
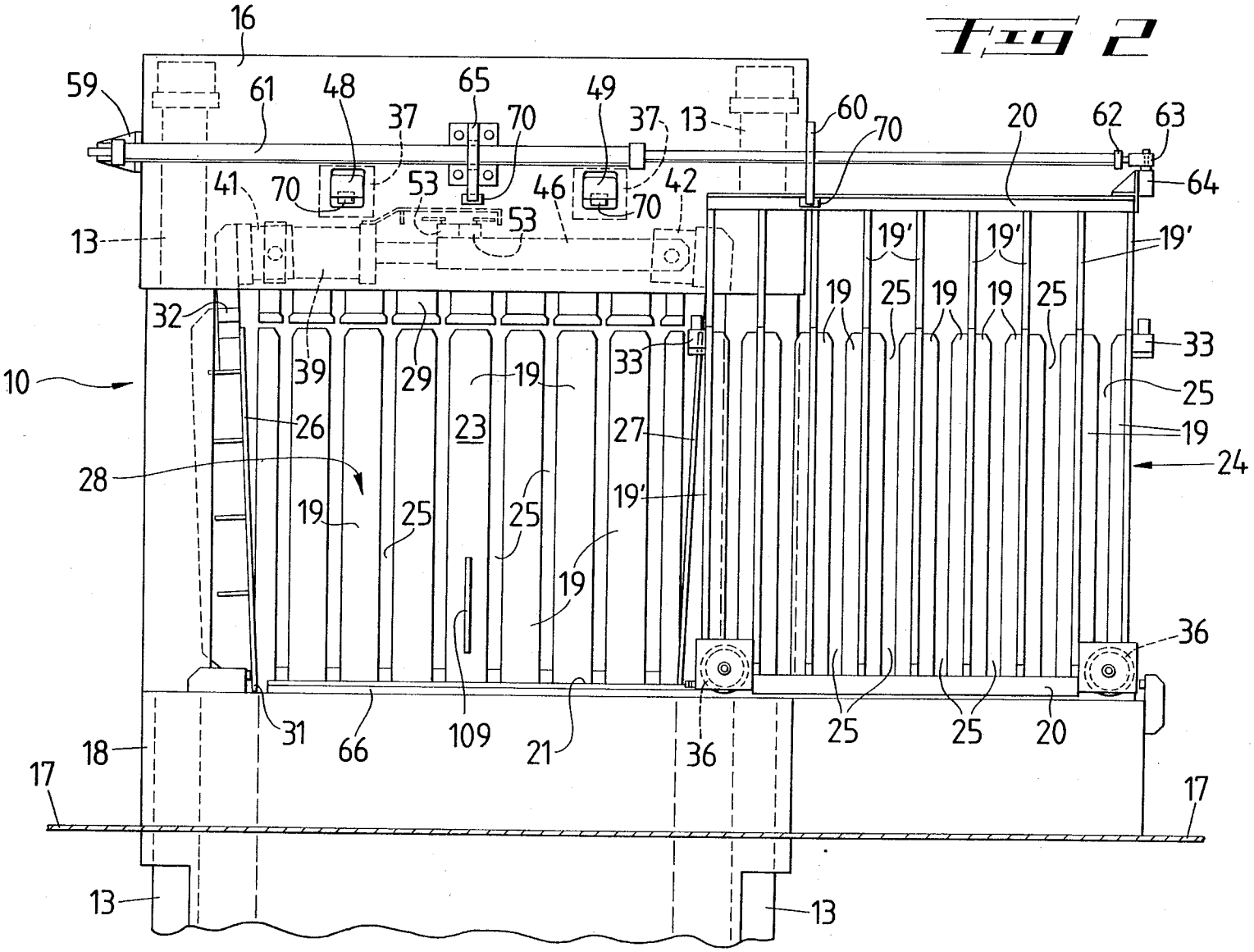
FIG. 2 is a front rear elevational view of the baling chamber with the roller mounted door open; and, FIG. 3 is a diagrammatic view showing the door release control mechanism.
Figure 3:
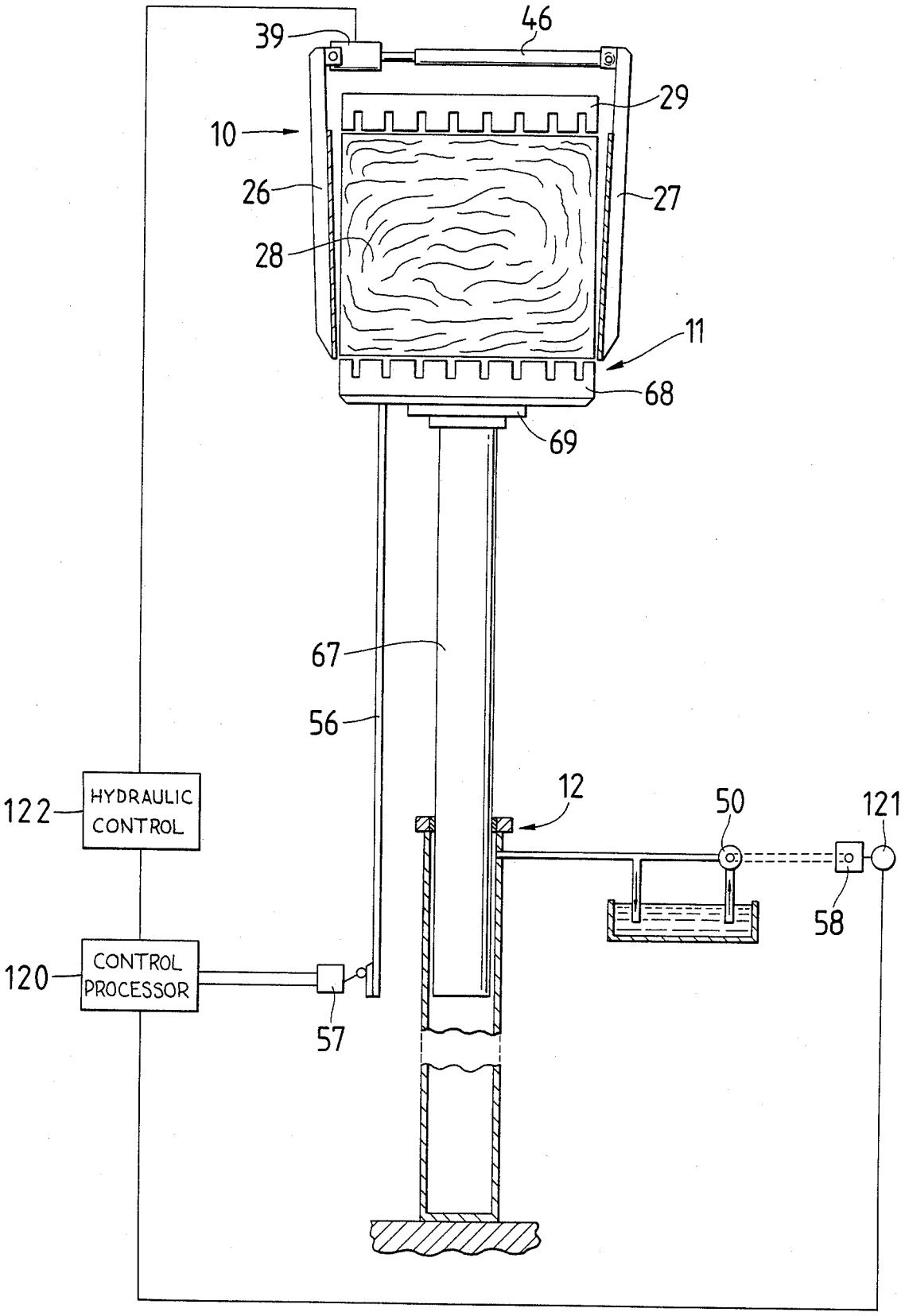

The upper portions of the doors, however, may be pivoted outwardly. Also mounted to the lower portion of each door 23–24 and 26–27 is a retaining bar 22 which cooperates with the flange 31 on its door to form a channel for receiving the projection 21, which is thereby located intermediate the flange 31 and the retaining bar 22. The retaining bar 22 abuts the outer surface of the projection 21 to prevent the flange 31 from moving inwardly as each door pivots on its respective flange. This outward motion of the upper portion of the doors is induced by two side door hydraulic cylinders 37 and an end door hydraulic cylinder 39. The end door hydraulic cylinder 39 is mounted between the two end doors 26 and 27 on cylinder mounting blocks 41 and 42 by a bar connector 46 such that the end door hydraulic cylinder 39 can force the upper portion of the doors apart or urge the doors into their closed upright position as required. Likewise, side door hydraulic cylinders 37 are mounted between front side door 24 and rear side door 23 by the use of extended cylinder mounting brackets 43 and locking bars 48 and 49, as shown in FIG. 2. Thus it can be seen that through the operation of the hydraulic cylinders the end doors act in opposition to one another, as do the side doors. Side door hydraulic cylinders 37 act in unison and may be replaced by a single cylinder with appropriate mounting hardware to equalize the lateral loading effect across the doors. Each of the cylinders 37 and 39 is matched to its paired end or side doors such that the same area to compression ratio is maintained over the area of the door. Limit switches 51–54 mounted intermediate the paired doors are used to insure that each door moves the proper distance away from its adjacent bale side. This is a result obtained by using common hydraulic cylinders on opposing doors and positioning the limit switches to allow each door to move the proper distance. The end door limit switches 53–54 are actuated at the proper spacing by their position relative to cylinder 39 and the side door limit switches 51–52 are actuated at the proper spacing by their position relative to the top sill 16.

It will be noted that the front side door 24 has mounted thereon rollers 36 which are situated above a track 66 which extends alongside and parallel to the front side door 24 and laterally beyond this front side door. A rear side door stop 55 limits pivotal motion of the top portion of the rear side door 23 at a predetermined location. Hydraulic cylinders 37 can then urge the top portion of the front side door 24 outward further thereby engaging rollers 36 with the track 66 and lifting flange 31 out of engagement with sleeve support 18. Mounted on the top sill 16 is a cylinder mounting bracket 59 to which is pivotally attached a door opening hydraulic cylinder 61 which extends above and parallel to the front side door 24. Attached to the piston rod of the cylinder 61 is a self-aligning rod coupler 62 and a knuckle 63 as well as a pivot bracket 64 which is connected to the end of front side door 24. Mounted along the top sill 16 in conjunction with the hydraulic cylinder 61 and the front side door 24 are an end cam roll bracket 60 and a center cam roll bracket 65 and the associated cam followers 70 which cooperate with other cam followers 70 on locking bars 48 and 49 to align the front side door 24 when hydraulic cylinder 61 is utilized to roll the front side door 24 to and fro to open and close the baling chamber 28. An ejection dog 109 is provided to automatically eject a tied bale from baling chamber 28 when front side door 24 is in the open position. This dog 109 utilizes the same principle as disclosed in U.S. Pat. No. 3,584,433, owned by the common assignee herewith and incorporated herein by reference.

It is to be understood that the up-packing baler herein described requires a ram 67 and the bottom platen 68 upon which the fibrous material or lint to be compressed is placed and a mounting bar 69 which connects the ram to the platen. Ram 67 and platen 68 reciprocate between the baling chamber 28 and a charging box, not shown, whereby lint or fiber delivered to a charging box is introduced into the baling chamber 28. Depending from the platen 68 is a control arm 56 which actuates a plurality of limit switches which are mounted in a conventional manner near the point of lowest travel of the platen. Such control arms and limit switches are well known and will not be further described except to say that such units are used to control the stroke of the ram 67 at the various stages of the baling process. For example, the tramp strokes are shorter than the final compression stroke which may be variable depending on the size and weight of the bale. All of these limit switches are connected to a processor 120 such as the Modicon M-84, which controls the operation of the baler. Of particular importance is the tramp stroke limit switch 57 which normally indicates to the processor 120 that the ram has reached its desired charging stroke, thus the processor logic reverses the ram motion to cause the same to descend and receive an additional charge of lint. However, a sensor 121 is also used to indicate the pressure exerted by the hydraulic ram in reaching the charging stroke. This sensor 121 may measure the amperage drawn by a motor 58 which drives a hydraulic pump 50 for the ram 67. The hydraulic pressure may also be sensed directly. Either method provides a measure of the bale weight as is well known and may be adjusted within a range to achieve a bale weight of approximately 500 pounds. It has been experimentally determined using a charging door arrangement disclosed in co-pending application Ser. No. 662,272, filed Oct. 18, 1984 , that normally the weight will be achieved in seven charging strokes. The sensor 121 may be adjusted so that the baler will run on an even pace rather than alternating between 7 and 8 or 7 and 6 charges per bale, which would affect the uniformity of the bale weight.

As previously noted the baling chamber 28 is formed by the rear and front side doors 23 and 24 and the two end doors 26 and 27. The upper portions of doors 23, 24, 26 and 27 are normally held closed in a vertical position by the associated hydraulic cylinders 37 and 39 that extend from one door to the opposite door. When these hydraulic cylinders 37 and 39 are filled with hydraulic fluid to close the doors, the hydraulic control system 122 cuts off the fluid return flow and initially the hydraulic cylinders 37 and 39 are set at a pressure of 1000 psi which is controlled by processor 120. This high pressure assures that the lateral expansion of the fibers as the main ram 67 compresses the charge of fiber vertically does not cause the doors to open at their tops. The door bottoms are restrained from outward movement by the flanges 31 abutting the projections 21 so that the door bottoms cannot move.

When the pressure sensor 121 indicates that the full bale weight has been charged and the tramp stroke limit switch 57 indicates that the ram 67 is at the top of the charging stroke, processor 120 causes a new sequence of events to occur. Instead of descending to receive another charge of lint, the ram 67 continues upward to further compress the bale within baling chamber 28. It is at this time that it becomes advantageous to reduce the lateral pressure on the bale by moving the doors of the baling chamber. Therefore, as the ram actuates the tramp stroke limit switch 57 on its upward travel, processor 121 causes the pressure in hydraulic cylinders 37 and 39 to fall to 100 psi. Thus the top of the side doors 23–24 and then the end doors 26–27 pivot out approximately ½ inch. It should be noted that the baling chamber is now tapered with its largest dimension at the top and its smallest dimension at the bottom. This configuration conforms to the configuration of the bale discussed in the first paragraph of the instant description. Therefore the decrease in lateral pressure will be uniform, both horizontally and vertically across the faces of the bale.

Ram 67 drives platen 68 upward to the tie-out position, indicated at "A", again under the control of processor 121 and the well known limit switch/control arm combination. Preferably, the tie-out position utilizes the variable-shut control techniques to vary the positioning of the bottom platen at tie-out position in accordance with bale weight, to avoid unduely stressing the fibers, the operator, or the press. At the tie-out position an operator manually inserts the ties through the slots 25 about the bale and secures them in standard fashion.

Inasmuch as the doors 23–24 and 26–27 are not attached to support sleeve 18, it is noted that the doors can be lifted by the upward force transferred by the bale as it is compressed. To prevent the flange 31 from becoming disengaged of projections 21, end doors 26 and 27 abut the top sill 16. The end doors 26 and 27 have ears 32 extending therefrom which engage stop 33 on the side door 23 and 24 to prevent upward motion thereof.

After the ties are affixed, the hydraulic system causes the hydraulic cylinders 37 and 39 to move the four doors away from contact with the formed bale and the front side door 24 continues to move to engage rollers 36 on track 66 on which the side door 24 will move laterally. At this point main ram 67 moves downward a short distance to tension the ties. Main ram 67 should be lowered slightly before the front side door 24 moves laterally in order to remove the slack from the bale ties which are in somewhat of an oval shape projecting through the slots in the doors prior to their tensioning. When this is accomplished the front side door 24 is rolled laterally out of the way of the forward face of the bale. Ram 67 is lowered so that ejection dog 109 engages an ejection platen 112 pivotally mounted into bottom platen 68 to eject the bale.

It is noteworthy to mention that front side door 24 is held in position by track 66 and locking bars 48 and 59, thus if a deformed bale should occur and thereby cause potentially high force to be exerted on door 24 it would not be forced abruptly open by the bale inasmuch as the door's direction of motion for opening would be perpendicular to the direction of the force exerted by the deformed bale. Cylinder 61 is not sufficiently large to overcome such large force thus the potentially dangerous bale is confined within the press until the situation can be remedied.

It is of course to be understood that there are a number of other switches and control inputs and outputs associated with operating a baler under the control of a processor, which have not been described. For example, warning signals, such as a light or horn, are actuated by certain operating parameters and the charging sequence utilizes a plurality of input and output signals. However, these inputs, outputs and associated functions may be conventionally configured and accomplished and are not considered to be a part of the invention to be claimed.

While we have shown our invention in but one form, it will be obvious to those skilled in the art that it is not so limited, but is susceptible of various changes and modifications without departing from the spirit thereof.

What we claim is:

1. In an up-packing baler having a supporting frame and a movable platen for compressing fibers into a bale:

(a) a baling chamber adapted to receive said movable platen and in part defined by four rigid upright doors with each of said doors being pivotally supported along its lower edge by said supporting frame so that its upper portion is movable inwardly and outwardly relative to said chamber;

(b) means responsive to the compressive force exerted on said fibers by said movable platen for decreasing the lateral pressure exerted on said fibers by said doors; and (c) means for displacing one of said doors for removing said bale from said baling chamber.

2. In a baler as in claim 1 wherein said means for decreasing lateral pressure exerted on said fibers comprises:

(a) means for sensing the compression exerted on said fibers by said movable platen;

(b) means for hydraulically positioning the upper portions of said upright doors responsive to the compression sensed by said sensing means; and (c) means utilizing said sensing means for controlling said positioning means.

3. In a baler as in claim 2 further comprising upstanding projections carried by said supporting frame outwardly of and adjacent said upright doors, said upright doors comprising a pair of end doors, a rear side door, and a front side door with each of said doors having a flange extending from the lower portion thereof, said flanges engaging said projections and supporting the weight of said doors, and said projections and flanges providing pivotal mountings for said doors.

4. In a baler as in claim 3 wherein said positioning means comprises:

(a) double-acting hydraulic cylinders operatively connected between said front and rear side doors, said hydraulic cylinders being operatively connected to said doors at the upper portion thereof such that said upper portions of said doors may be held in their normal upright position or urged outwardly a predetermined distance; and (b) a door stop for arresting the outward motion of the upper portion of said rear side door at a predetermined position.

5. In a baler as in claim 4 further comprising means for selectively positioning the upper portion of said end doors to a vertical position and a position offset from vertical.

6. In a baler as in claim 4 wherein said front side door has rollers mounted thereon with said rollers supporting the weight of said door from said flange when said upper portion of said front side door is urged outwardly a second predetermined distance, said front door being slidably attached to said hydraulic cylinders such that said door can be moved away from said baling chamber on said rollers.

7. In a baler as in claim 6 wherein said front side door is movable along a horizontal track engaged by said rollers when said rollers bear the weight of said door, and means operatively connected to said front side door for urging said front side door along said track selectively to an open position and a closed position.

8. In a baler as in claim 3 wherein said rear side door and said front side door each comprise:

(a) a plurality of vertical members horizontally spaced apart;

(b) a plurality of vertical strength members each reinforcing one of said vertical members; and (c) horizontal connecting and strengthening beams connected to said vertical members and said vertical strength members across the top and bottoms of said doors.

9. In a baler as in claim 1 wherein said upright doors have vertical slots therein for receiving bale ties whereby said bale may be tied while within said baling chamber.

10. In a baler as in claim 1 in which an ejection dog is positioned within said baling chamber in position to cooperatively engage said moving platen, after said bale has been compressed to eject said bale from said baling chamber.

* * * * *